United States Patent [19]

Kuwertz

[11] 4,108,078

[45] Aug. 22, 1978

[54] COUPLING APPARATUS ON A CIRCULATING TOW CONVEYOR

[75] Inventor: Erich Kuwertz, Trippstadt, Germany

[73] Assignee: Pfalzstahlbau GmbH, Trippstadt, Germany

[21] Appl. No.: 773,838

[22] Filed: Mar. 2, 1977

[30] Foreign Application Priority Data

Mar. 6, 1976 [DE] Fed. Rep. of Germany ..... 2609371

[51] Int. Cl.[2] ..... B61B 10/02

[52] U.S. Cl. ..... 104/172 S; 104/250

[58] Field of Search ..... 104/250, 89, 172 C, 104/172 S, 178

[56] References Cited

U.S. PATENT DOCUMENTS

| | | | |
|---|---|---|---|
| 3,712,241 | 1/1973 | Kuwertz | 104/172 S |
| 3,793,965 | 2/1974 | Winters | 104/172 S |
| 3,882,793 | 5/1975 | Wakabayashi | 104/172 S |
| 3,906,864 | 9/1975 | Kuwertz | 104/172 S |
| 3,995,561 | 12/1976 | Allor | 104/172 S |

*Primary Examiner*—Robert G. Sheridan
*Assistant Examiner*—Carl Rowold
*Attorney, Agent, or Firm*—Orville N. Greene; Frank L. Durr

[57] ABSTRACT

In a coupling apparatus for a circulating tow conveyor in which the carriages are held on a track with a portion running parallel to circulating tow chain and in which a coupling finger on the tow chain cooperates with coupling means on the conveyor, the coupling finger of the tow chain is pivotally mounted in a housing and is normally held in its vertical position by means of a locking lever which prevents the finger from pivoting out of contact with the cooperating coupling on the carriage but does not prevent pivotal movement of the finger in the opposite direction so that carriages pushed faster than the tow chain moves can be moved past one or more fingers on the tow chain. A releasing lever is provided to release the locking lever and, therefore, the carriage when the release lever is operated.

1 Claim, 4 Drawing Figures

COUPLING APPARATUS ON A CIRCULATING TOW CONVEYOR

The invention concerns a coupling apparatus for a circulating tow conveyor with which carriages are provided which travel at the side of the tow chain on approximately arranged rails. Between the tow chain and the carriages, coupling means are provided which permits a locking in of the carriage to the tow chain as well as a releasing of the carriage from the tow chain.

These kinds of coupling apparatuses are known with multivariant constructions. Essentially, catches are provided on the tow chain which project in the advancing path of the carriage or part thereof. These catches are arranged as catch fingers or levers around a horizontally extending axle, which are pivotally and barricadably arranged in a suitable catch housing on the tow chain.

Since the main thing is to advance the carriage in the horizontal direction but these are to be moved also over inclined feeding stretches which further are to be conveyed not only over conveyor curves, but also over switch arrangements or the like to subsidiary paths, it would be appropriate to develop the special posting of the coupling apparatus spaced along the device, thus it might be equipped, e.g. with releasable levers, locking levers and the like which would operate with or near the essential coupling fingers.

Deviating from the until-now known loading stations and their respective releasing means, the present invention is based on the problem to so improve the coupling apparatus that the carriages e.g., can be pushed through easily, so to speak, to overtake one or more of the carriage coupling devices extending forward thereof in the feed direction. This is not possible with the known coupling apparatus since here the entrainment finger in its downward directed and stopping position will be a hindrance. What also matters, is to so construct the coupling apparatus that the catch finger, when it is contacted from behind by a suitable to-be-shoved-through carriage can be pivoted by the carriage to permit the carriage to pass in front of it. Similarly however, good kinematics in cooperation with the catch finger and the remaining moving parts of the coupling device as with the known kind of apparatus should remain operative.

The invention solves the said problem in a coupling apparatus for circulating two conveyors with a track for rolling the same arranged near the tow chain by providing a carriage equipped with two mechanisms for cooperation with the movable coupling parts on the catches of the tow chain whereby further the coupling parts arranged on the catch of the tow chain are contained in a housing in which a catch finger and a lock lever in working connection therewith is situated, both being pivotally mounted around horizontal axes and further, a releasing lever pivotally mounted about a horizontal axis is provided, in such a manner that the locking lever is swingable upwardly around its pivoting axis from its catch finger arresting position and is secured in its lower position through a bar or the like and which can be raised by a pivotable releasing lever likewise mounted on a horizontal axis, transverse to the feed direction.

In the following description an embodiment of the invention is further explained in connection with the attached schematic drawing wherein.

Figures 1, 2, 3:
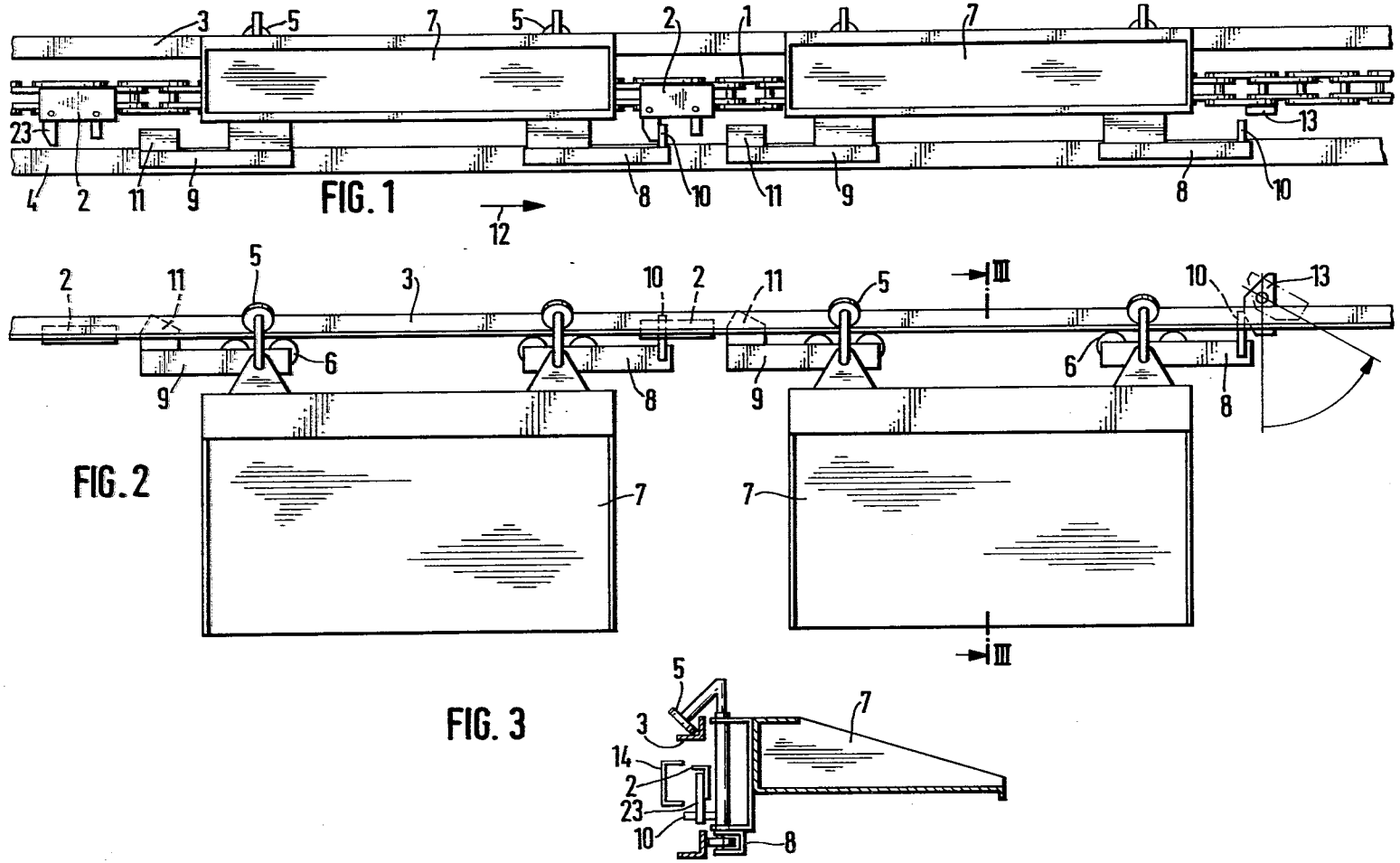
FIG. 1 shows the coupling apparatus with a section of the circulating tow conveyor in side view.
FIG. 2 shows the same section in plan view.
FIG. 3 is a cross-sectional view taken on line III — III of FIG. 2.

On a tow chain 1, entrainment means 2 are arranged at uniform distances, parallel with the tow chain 1, an upper rail 3 and a lower rail 4 are provided on which the rollers 5 and 6 of the travelling carriages 7 run. In the shown embodiment, the carrying rollers 5 are provided with sloping axles and run in an angularly formed upper rail 3 while the carrying rollers 6, having a vertical axle, are supported horizontally on the lower rail 4.

The travelling carriages 7 are each equipped with two drive assemblies, a forward drive assembly 8 and a rearward drive assembly 9 which carry the rollers 5 and 6. The forward drive assembly 8 of the carriage 7 is always equipped with a coupling dog 10 and the rear drive assembly is equipped with a decoupling lug 11.

The coupling dog 10 and the decoupling 11 cooperate with a downwardly projecting, to-be-described parts of the entrainment means 2 of the towing chain 1. The conveyor direction is indicated by arrow 12 in FIG. 1. Besides the coupling device on the travelling carriage, stationary decoupling devices 13 are provided at suitable places along the towing chain which operates the decoupling of the coupling dog on the carriage from the coupling lug on the tow chain and stops the carriage. The tow chain 1 is guided in a chain guide track 14.

With the known coupling devices of this type, the couplers on the tow chain are equipped with one or more downwardly projecting fingers or levers, which, if necessary under the interposition of a further lever, can be seized in its vertical position and thus, in cooperation with the coupling dog to the carriage, transmits to-this carriage the feed of the tow chain. Under certain conditions and through suitable action from without, these coupling fingers or the like can be swivelled from their vertical position so that they can be slid away over the suitable catch part of the carriage and so that the intervening connection for feeding between the tow chain and the carriage for the conveyance is interrupted. The known coupling fingers or the like are, however, one and all so constructed, placed and controlled that it is not possible to put a carriage in motion quickly as the tow chain rotates, thus, as it were, to overtake one or more couplers of the tow chain. The arresting coupling finger standing in its vertical position opposes such movement. In the practice in which such circulating two conveyors are set up, there exists frequently, however, the demand, as on starting, to be able to set one or more carriages in faster in the feed direction than the tow chain and past the obstructions on the runway rail. In addition, there is a requirement for suitable means for releasing the coupling finger from its vertical arresting position so that it swings away forwardly of the feed direction under the operation of the coupling dog and the decoupling lug of a carriage rolling faster in the feed direction and thus can turn aside the coupling dog and the decoupling lug of the carriage.

To this end, there is provided, on the tow chain 1, a fixed coupling housing 21 provided, first of all, with a gudgeon 22 extending in a horizontal direction laterally of feed direction, pivotably holding coupling finger 23 which through a locking lever 24 can be arrested in its vertical position. Also, this locking lever 24 is pivotal about a horizontal pin 25 and is secured in its horizontal arresting position with respect to the coupling finger 23 through a rod 26. Here it is supported with its rear surface 27 against the upper area 28 of the shifting side of the coupling finger 23 and stops the latter in its vertical position. Furthermore, a release lever 29 is provided which also is pivotal on a horizontal gudgeon 30. Through operation from the outside, e.g., through running onto a decoupling device 13, the release lever 29 pivots from its horizontal position and lifts at any time by pivoting by means of a nose 32 or a rounded off area 33, the locking lever 24 so that the latter releases the coupling finger 23.

The arrangement and suspension of the coupling finger 23 in the coupling housing 21 is now so affected that it can be pivoted without being hindered by the locking lever 24 or other part of the coupling housing or under the influence e.g. of a coupling lug 10 on the forward drive assembly 8 of a carriage 7 so that the coupling lug 10 and therewith the carriage can pass under and overtake the coupling apparatus on the tow chain.

Figure 4:
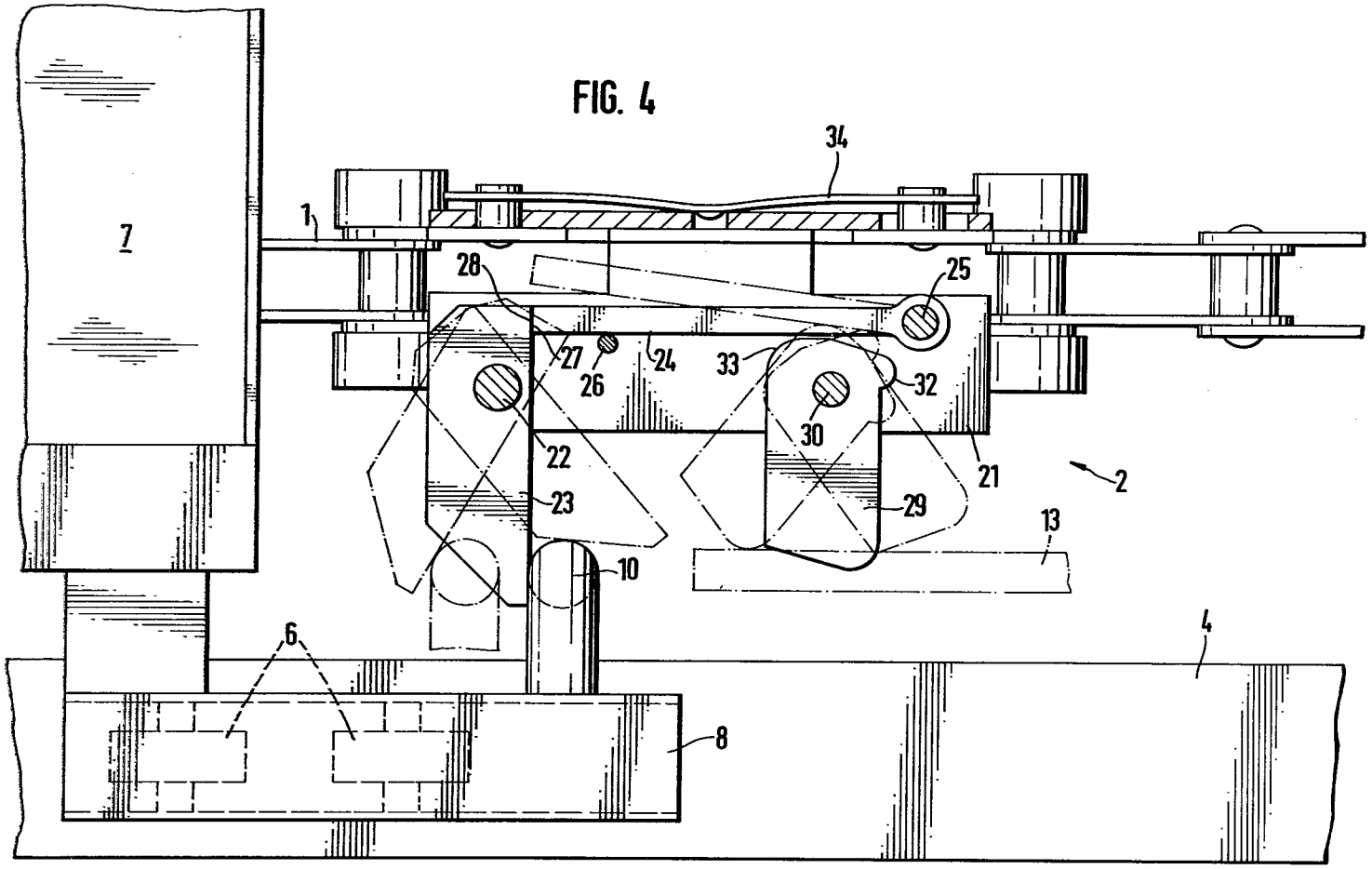
FIG. 4 shows the details of the coupling apparatus, again in a side view and on an enlarged scale.

As is obvious from FIG. 4, the coupling housing 21 are fixed at the places of the tow chain 1 provided along the chain with a spring coupling fastener 34.

In FIGS. 2 and 3, the chain 1 has been intentionally omitted to avoid confusion.

I claim:

1. In a coupling apparatus for a circulating tow conveyor of the type having a tow chain and carriages which run on a track at least a portion of which is parallel to the tow chain and having coupling means between the tow chain and the carriages which coupling means comprises at least one swingable and lockable catch finger on the tow chain and a cooperative catch means on the carriages, the improvement comprising at least one housing on the tow chain, said catch finger being mounted in said housing for pivotal movement about a horizontal axis extending transversely of the feed direction and having a first contact portion extending into the path of the cooperative catch means on the carriages and a second contact portion, an arresting locking lever pivotally mounted in said housing, said locking lever having one end thereof adapted to press against said second contact portion of said catch finger to prevent pivotal movement of the lever in the direction to move the first contact portion opposite to the feed direction, a loosening lever pivotally mounted in said housing at such a distance from the catch finger as to not interfere with the pivotal movement of the latter, said loosening lever being mounted for pivotal movement in the feed direction and also opposite to the feed direction to move the locking lever out of contact with said second contact portion of the catch finger, stationary means in the path of the tow chain adapted to operate said loosening lever opposite to the feed direction to release the locking lever when the carriage is to be released from the tow chain, said loosening lever being pivoted in the feed direction by contact with the cooperative catches on said carriages to a position out of the path of movement of said cooperative catches whereby carriages can be shoved past the catch finger and the locking lever of the tow chain in the feed direction of the tow chain, said carriages being normally retained for movement by the catch finger.

* * * * *

UNITED STATES PATENT OFFICE

CERTIFICATE OF CORRECTION

Patent No. 4,108,078 Dated Aug. 22, 1978

Inventor(s) Erich Kuwertz

It is certified that error appears in the above-identified patent and that said Letters Patent are hereby corrected as shown below:

On the title page, after "Assignee:" change

"Trippstadt" to -- Pirmasens/Pfalz --

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*